US007439994B2

(12) United States Patent
Abe et al.

(10) Patent No.: US 7,439,994 B2
(45) Date of Patent: Oct. 21, 2008

(54) THERMAL TRANSFER LINE PRINTER

(75) Inventors: Yoshibumi Abe, Fukushima-ken (JP); Takashi Onozato, Fukushima-ken (JP); Minoru Sato, Fukushima-ken (JP); Zenko Motoki, Fukushima-ken (JP); Susumu Arauchi, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/928,813

(22) Filed: Oct. 30, 2007

(65) Prior Publication Data

US 2008/0100687 A1 May 1, 2008

(30) Foreign Application Priority Data

Nov. 1, 2006 (JP) ..... 2006-297853

(51) Int. Cl.
*B41J 17/00* (2006.01)

(52) U.S. Cl. ..... 347/215

(58) Field of Classification Search ..... 347/215, 347/217, 218, 222, 221, 220, 198, 197; 358/1.2
See application file for complete search history.

(56) References Cited

U.S. PATENT DOCUMENTS 5,008,684 A * 4/1991 Kurafuji ..... 347/197
6,278,473 B1 * 8/2001 Veigl ..... 347/213
7,271,820 B2 * 9/2007 Shimizu ..... 347/197

FOREIGN PATENT DOCUMENTS

JP 08-072335 3/1996

* cited by examiner

*Primary Examiner*—K. Feggins
(74) *Attorney, Agent, or Firm*—Brinks Hofer Gilson & Lione

(57) ABSTRACT

A printer capable of printing high-quality recording is provided. A driving force transmission gear mounted on a platen roller, driven rollers mounted on a pair of conveying rollers, respectively, and intermediate gears that always mesh with both the driving force transmission gear, and the driven rollers form a re-transmission mechanism that re-transmits the driving force transmitted to the platen roller from a driving motor to each of the one pair of conveying rollers. Also, gear supporting shafts that rotatably support intermediate gears are configured so as to be adjustable in position.

3 Claims, 8 Drawing Sheets

THERMAL TRANSFER LINE PRINTER

CLAIM OF PRIORITY

This application claims benefit of the Japanese Patent Application No. 2006-297853 filed on Nov. 1, 2006, which is hereby incorporated by reference.

BACKGROUND

1. Field of the Invention

The present invention relates to a thermal transfer line printer, and particularly, to a small-sized thermal transfer line printer that can reciprocate a recording medium to form a full color image on the surface of the recording medium.

2. Description of the Related Art

Conventionally, a thermal transfer line printer that can perform recording in a direction orthogonal to the conveying direction of a recording medium by means of a line thermal head having a length corresponding to the recording ranges of a recording medium in its longitudinal and transverse directions is known (for example, refer to JP-A-08-072335 (FIG. 1)).

FIG. 11 shows an example of a conventional thermal transfer line printer. This conventional thermal transfer line printer 101 is configured so as to be able to perform recording in a direction orthogonal to the conveying direction of a recording medium 104 by turning down a line thermal head 105 having a length corresponding to the recording range of a recording medium 107 in its longitudinal or transverse direction and making the line thermal head abut against a platen roller 102 by way of an ink film 103, such as an ink ribbon or an ink sheet, or a recording medium 104, such as a recording sheet, rotationally driving the platen roller 102, and a first conveying roller 106 and the second conveying roller 107 that constitute a conveying mechanism in a state where the line thermal head 105 that is turned down is abutted against the platen roller 102, and selectively driving a plurality of heat generating elements of the line thermal head 105 on the basis of recording information while the ink film 103 and the recording medium 104 are conveyed to make them generate heat, thereby thermally transferring the ink of the ink film 103 to the recording medium 104.

More specifically, when recording is performed by the thermal transfer line printer 101, the recording medium 104 is conveyed towards the right of FIG. 11 from the left of FIG. 11 by a conveying mechanism made up of the first conveying roller 106, the second conveying roller 107, etc.

The first conveying roller 106 and the second conveying roller 107 are disposed on the right and left of the line thermal head 105, and a first pressure contact roller 106*a* and a second pressure contact roller 107*a* that are brought into pressure contact with the first conveying roller 106 and the second conveying roller 107 to rotate following them are disposed above the first conveying roller 106 and the second conveying roller 107. Also, the recording medium 104 can be sandwiched by the first second conveying roller 106 and 107 and the first and second pressure contact roller 106*a* and 107*a*. As the conveying rollers 106 and 107 rotate in the forward rotation direction or reverse rotation direction, for example, in the clockwise direction, or counterclockwise direction, the recording medium 104 can be conveyed in the right and left directions. Specifically, the forward conveyance of a recording medium from the upstream side to the downstream side in the conveying direction that is directed to the right of FIG. 11, and the reverse conveyance of a recording medium from the downstream side to the upstream side in the conveying direction that is directed to the left of FIG. 11, can be performed.

On the other hand, the platen roller 102 that is rotated in the forward rotation direction or reverse rotation direction (for example, in the clockwise direction or counterclockwise direction) is disposed in a lower part of FIG. 11 that faces the line thermal head 105, and the recording medium 104 can be sandwiched between the line thermal head 105 and the platen roller 102.

The first conveying roller 106 and the second conveying roller 107 are rotationally driven by sequentially transmitting the driving force of a driving motor (a first driving motor) (not shown) that is provided below the first conveying roller 106.

That is, the driving force of the first driving motor is transmitted to one end of a rotary shaft of the first conveying roller 106, thereby rotationally driving the first conveying roller 106, and a driving force is transmitted to the second conveying roller 107 from the other end of the first conveying roller 106 to which that the driving force of this first driving motor has been transmitted, thereby rotationally driving the second conveying roller 107. Generally, toothed belt transmission and gear transmission are used for such driving force transmission.

As for the rotational driving of the platen roller 102, a driving motor (a second driving motor) (not shown) is separately provided below the platen roller 102, and the platen roller 102 is rotationally driven independently by the driving force of the driving motor.

Generally, an ink film having a configuration in which three color inks of at least three primary colors including Y (yellow), M (Magenta), and C (cyan) are repeatedly arranged in the conveying direction of the recording medium 104 in is used for full color recording.

When full color recording is performed in the thermal transfer line printer 101 having such a configuration, the head of the recording medium 104 is first detected by a medium detection sensor 108 in first color recording operation (first recording operation). At that time, the recording medium 104 is sandwiched by the first conveying roller 106 and the first pressure contact roller 106*a*. Thereafter, when the recording medium 104 is conveyed to the downstream side in the right and left conveying direction of FIG. 11 by the first conveying roller 106 (forward conveyance), a front end of the recording medium 104 will be sandwiched between the line thermal head 105 that is turned down and the platen roller 102.

At this time, the recording medium 104 is sandwiched at two places by the pressure contact between the first conveying roller 106 and the first pressure contact roller 106*a*, and the pressure contact between the line thermal head 105 and the platen roller 102.

Then, while the recording medium 104 is sandwiched between the platen roller 102 and the line thermal head 107, the recording medium 104 is conveyed to the downstream side, and thermal transfer of the first color ink is started from the front end of the recording medium 104. In the course of this thermal transfer, the recording medium 104 is sandwiched at three places by the pressure contact between the first conveying roller 106 and the first pressure contact roller 106*a*, the pressure contact between the line thermal head 105 and the platen roller 102, and the pressure contact between the second conveying roller 107 and the second pressure contact roller 107*a*.

When the first recording operation is completed, the line thermal head 105 is turned up against the biasing force of a spring 109. Then, the recording-medium 104 that is brought pressure contact with and sandwiched between the second conveying roller 107 and the second pressure contact roller 107*a* and has been subjected to the first color recording is conveyed in the reverse direction (reverse conveyance) towards the upstream side in the conveying direction in the left direction of FIG. 11 between the line thermal head 105 that is turned up and the platen roller 102, by rotational driving in the counterclockwise direction (reverse rotation direction) of the second conveying roller 107.

Then, the reversely conveyed recording-medium 104 pushes down a contact 108*a* of the medium detection sensor 108 leftward of FIG. 11. Further, the recording medium 104 is sandwiched by the second conveying roller 107 and the second pressure contact roller 107*a*, and is further fed back by counterclockwise rotation of the first conveying roller 106.

Thereafter, when the contact 108*a* of the medium detection sensor 108 is out of the front end of the recording medium 104 and becomes upright, the front end of the recording medium 104 is detected, and then the rotation of the first conveying roller 106 is stopped. Then, the same recording operation as the first recording operation is repeated, thereby overlappingly recording an image of a second color on the image of the first color in the second recording operation.

Then, the same process is performed, thereby overlapping recording images of third or fourth colors on the image of the second color, so that a desired color image can be recorded on the recording medium 104 in the third and fourth recording operation.

However, in the conventional thermal transfer line printer 101, the driving force of the first driving motor is transmitted to the first conveying roller 106, and the driving force is re-transmitted to the second conveying roller 107 from the first conveying roller 106 to which the driving force has been transmitted, and a rotation driving mechanism in which backlash is provided in meshing portions between teeth for toothed belt transmission, gear transmission, etc. is provided are used for the transmission of the driving forces. Therefore, the total amount of backlash in a transmission path of a driving force is obtained by adding individual backlashes. Thus, there is a problem in that, as the total number of meshing portions between teeth interposed between a driving member, such as a motor, and driven members, such as the conveying rollers 106 and 107, becomes more, the total amount of the backlash become large, consequently uneven conveyance of the recording medium 104 occurs, and thus exact conveyance cannot be performed. As a result, when full color recording is performed on the recording medium 104, there is also a fear that color deviation is caused in different ink colors on an ink film 103 where overlapping recording is made, and thus high-quality recording cannot be performed.

Further, in the conventional thermal transfer line printer 101, the driving force of the first driving motor is transmitted to the first conveying roller 106, and the driving force is re-transmitted to the second conveying roller 107 from the first conveying roller 106 by which the driving force has been transmitted. Therefore, there is also a problem in that deviation may be caused between the starting timing of the first conveying roller and the starting timing of the second conveying roller 107 due to a difference in the amount of backlash.

In addition, in the conventional thermal transfer line printer 101, there is also a problem in that the first driving motor that drives the first and second conveying rollers 106 and 107, and the second driving motor that drives the platen roller 102 are provided independently, and a need for reducing cost cannot be met.

Thus, a printer that can record high-quality recording without causing conveyance unevenness of a recording medium nearly is required.

SUMMARY

A thermal transfer line printer according to an aspect of the disclosure includes: a platen roller to which the driving force of a driving motor is transmitted, and that is rotationally driven in the forward rotation direction or reverse rotation direction. A line thermal head is provided so as to face the platen roller and so as to be brought close to or separated from the platen roller. One pair of conveying rollers are rotatably disposed with the platen roller therebetween. A re-transmission mechanism is provided that re-transmits the driving force, which is transmitted to the platen roller from the driving motor, to each of the one pair of conveying rollers. Here, the re-transmission mechanism has a driving force transmission gear mounted on the platen roller, a driven roller mounted on each of the one pair of conveying rollers, and an intermediate gear that always meshes with both the driving force transmission gear and the driven roller. Each of the one pair of conveying rollers is formed so as to be rotationally driven in the same direction as the direction of rotation of the platen roller. The intermediate gear is rotatably supported by a gear supporting shaft, and the gear supporting shaft is adjusted in position so that both the center distance between the axis of the intermediate gear and the axis of the driving force transmission gear and the center distance between the axis of the intermediate gear and the axis of the driven roller can be adjusted. By adopting such a configuration, a driving force transmitted to the platen roller is re-transmitted to the one pair of conveying rollers, so that each of the one pair of conveying rollers can be driven to follow the platen roller. Thus, the platen roller and the one pair of conveying rollers can be driven by one driving motor. Also, the total number of gears between a driving member and a driven member can be reduced, and the amount of the backlash of a driving force transmission path can be reduced. Moreover, the numbers of gears in the driving force transmission paths from the platen roller to the one pair of conveying rollers, respectively, can be made equal to each other. Therefore, the amounts of backlash in the driving force transmission paths can be made equal to each other. Furthermore, the position of the gear supporting shaft can be adjusted. Thus, it is possible to easily and reliably control the amount of the backlash between the intermediate gear and the driving force transmission gear, and the amount of the backlash between the intermediate gear and the driven roller.

Preferably, the position of both ends of the gear supporting shaft after positional adjustment is fixed. By adopting such a configuration, it is possible to reliably prevent the gear supporting shaft from being displaced due to a load applied to the intermediate gear, etc. Preferably, a distal end of the gear supporting shaft is formed so as to be able to be fixed without applying the force that will bend the gear supporting shaft. By adopting such a configuration, the distal end of the gear supporting shaft can be fixed firmly.

According to the thermal transfer line printer of the aspect of the disclosure, conveyance unevenness of a recording medium hardly occurs. Thus, high-quality recording can be performed easily and reliably.

DESCRIPTION OF THE EMBODIMENTS

Figure 1:
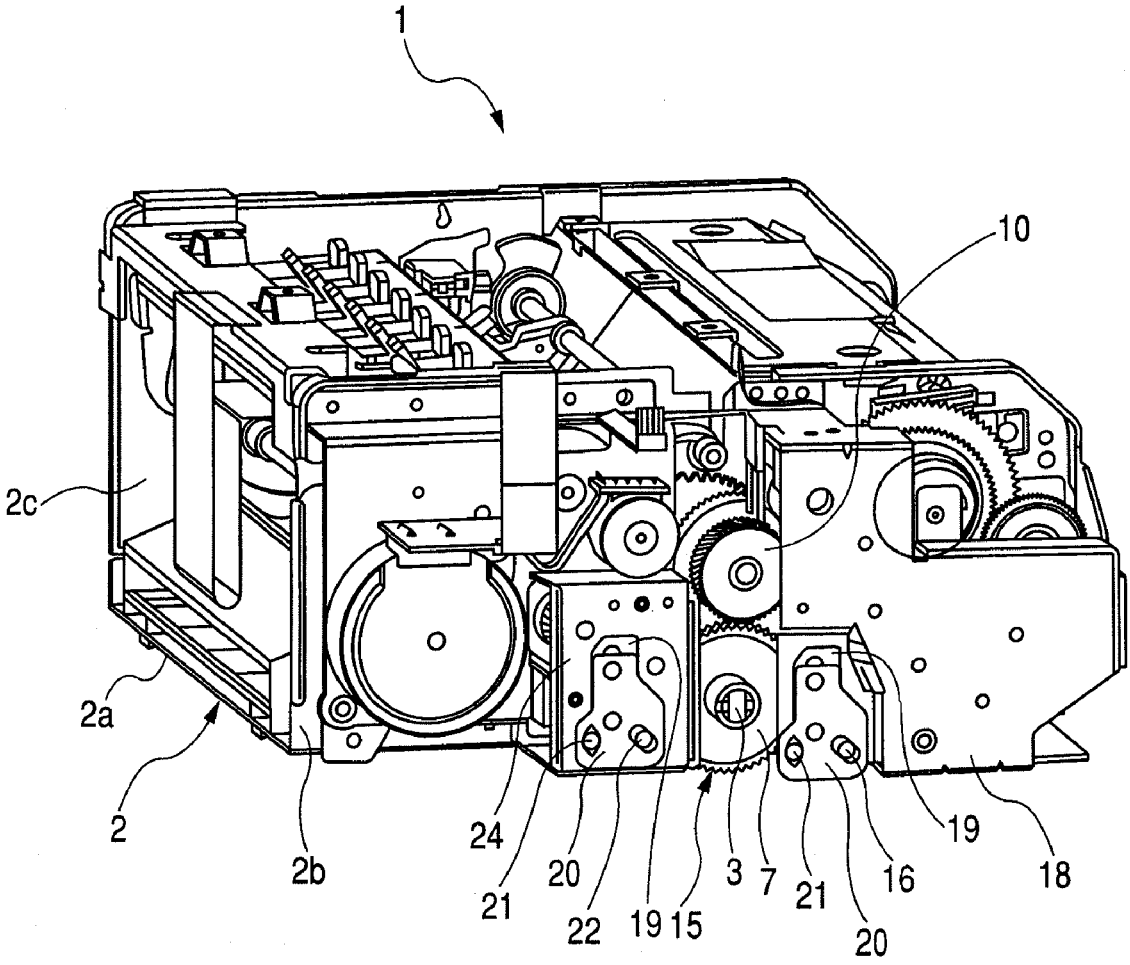
FIG. 1 is an external perspective view showing essential parts of a thermal transfer line printer according to an embodiment of the disclosure.

Hereinafter, the invention will be described by the embodiments shown in the drawings.

Figure 2:
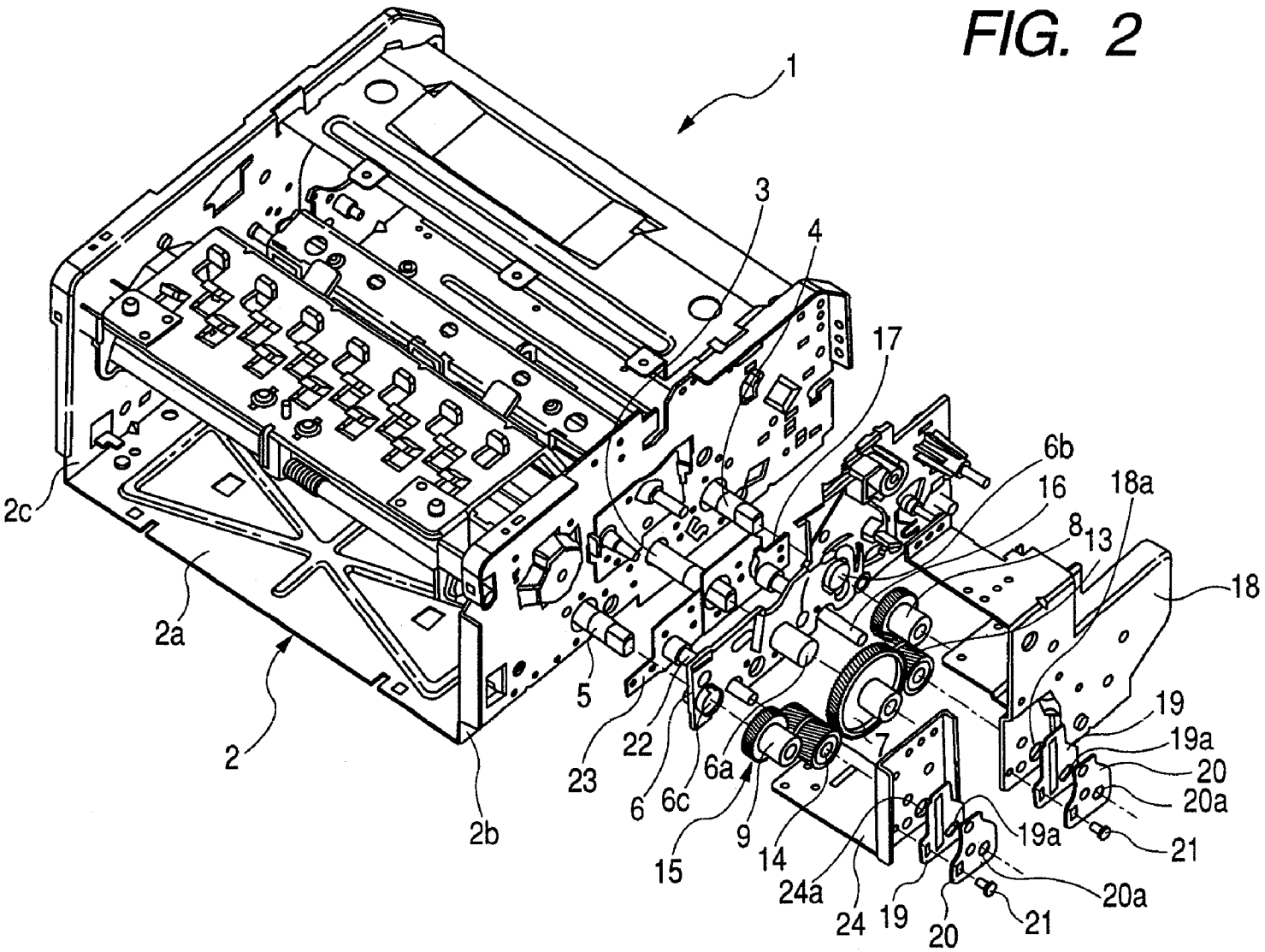
FIG. 2 is a partially exploded and enlarged perspective view of the essential parts of FIG. 1.
Figure 3:
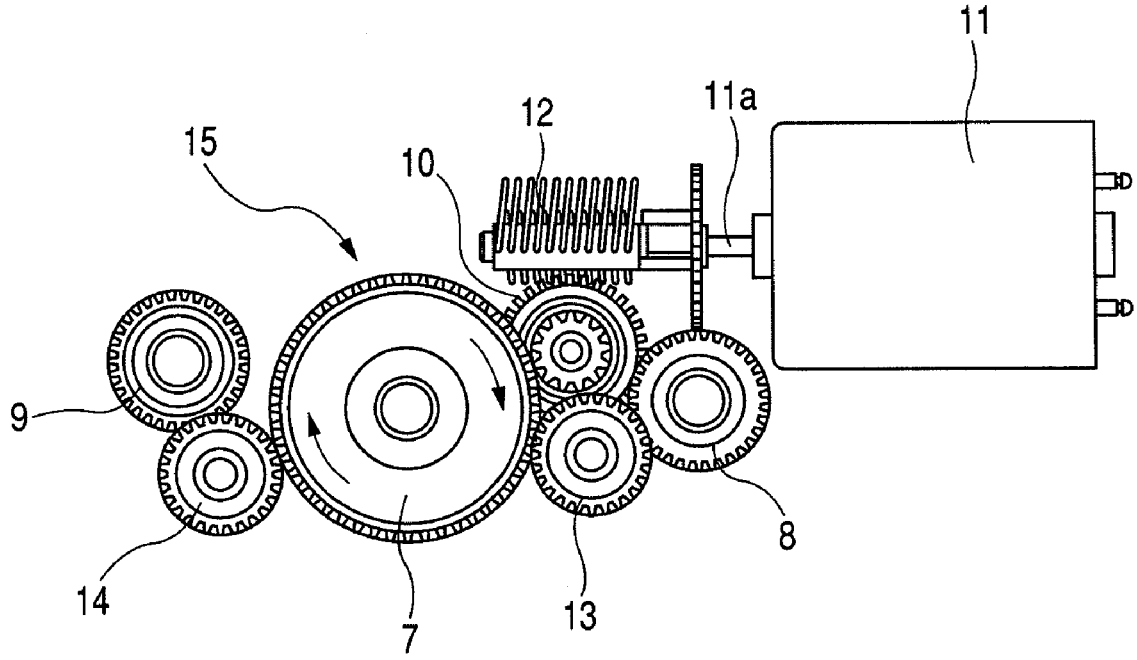
FIG. 3 is a front view in the vicinity of a re-transmission mechanism.
Figure 4:
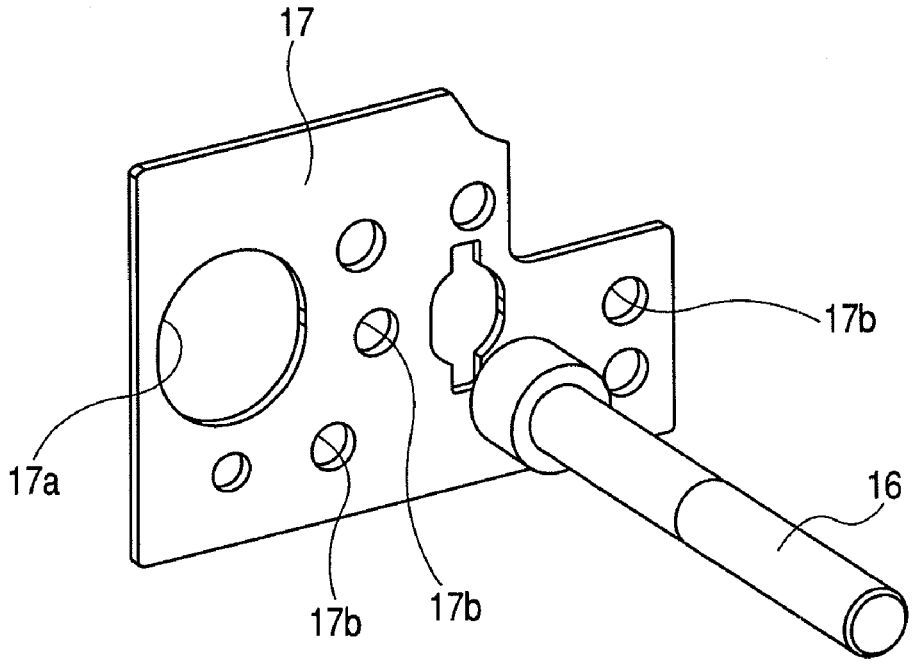
FIG. 4 is an enlarged perspective view in the vicinity of a first gear pivot.
Figure 5:
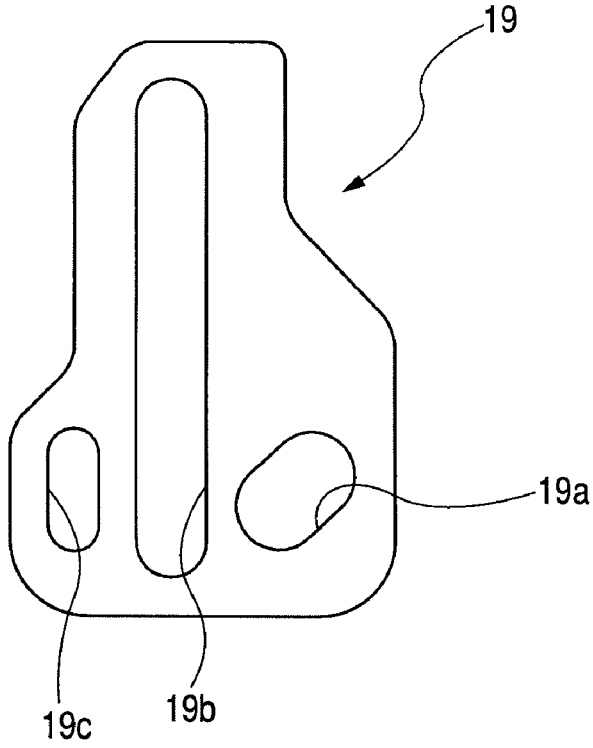
FIG. 5 is an enlarged front view of a lower plate.
Figure 6:
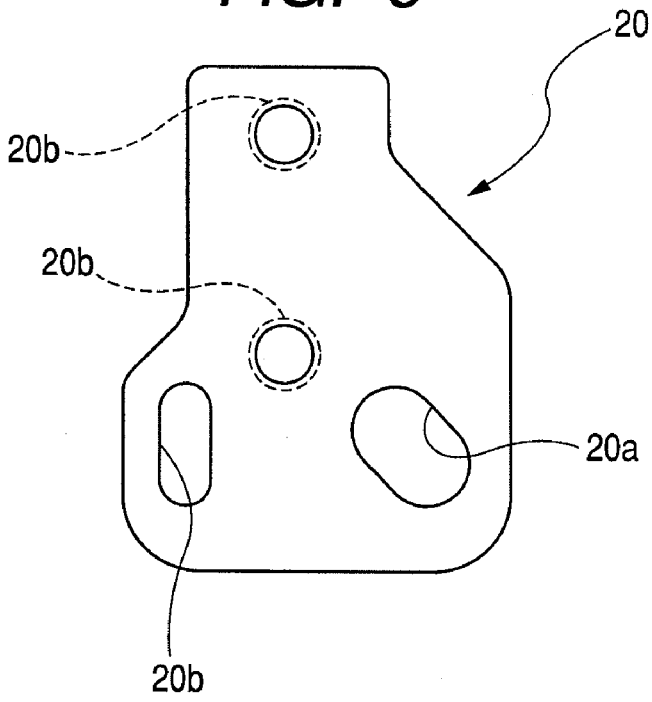
FIG. 6 is an enlarged front view of an upper plate.
Figure 7:
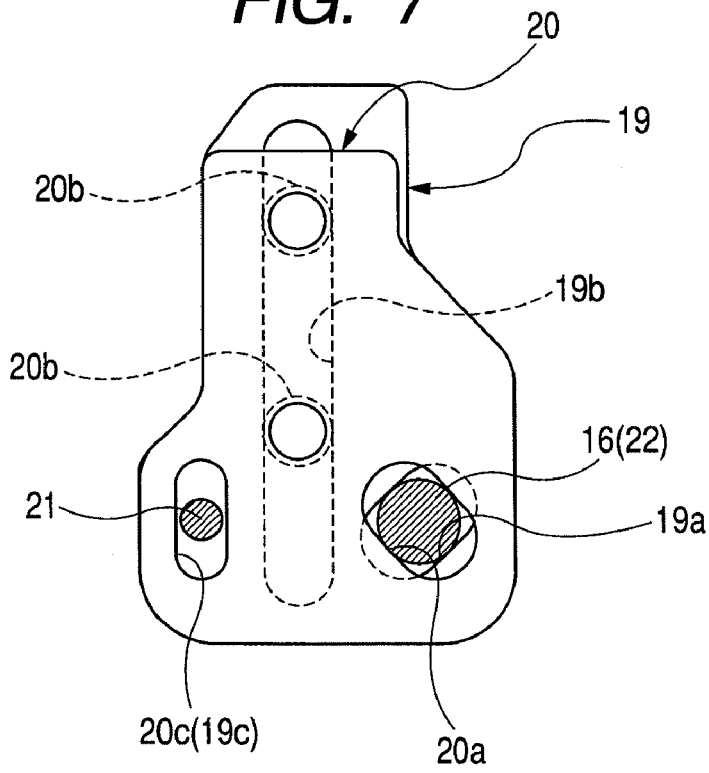
FIG. 7 is an enlarged front view showing a state where the upper plate is superposed on the lower plate.
Figure 8:
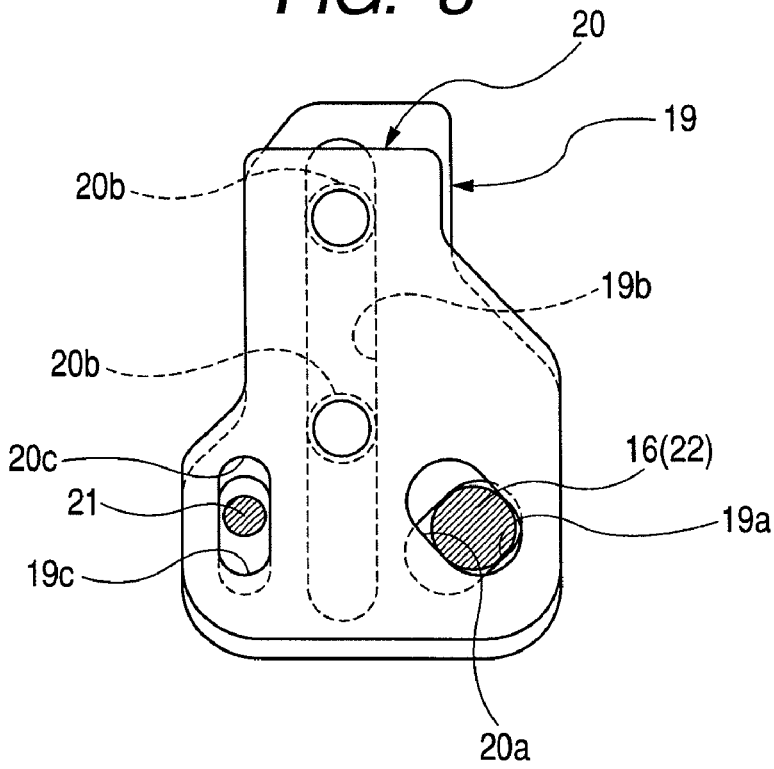
FIG. 8 is an enlarged front view showing an example of a state where the position of the upper plate superposed on the lower plate has been moved.
Figure 9:
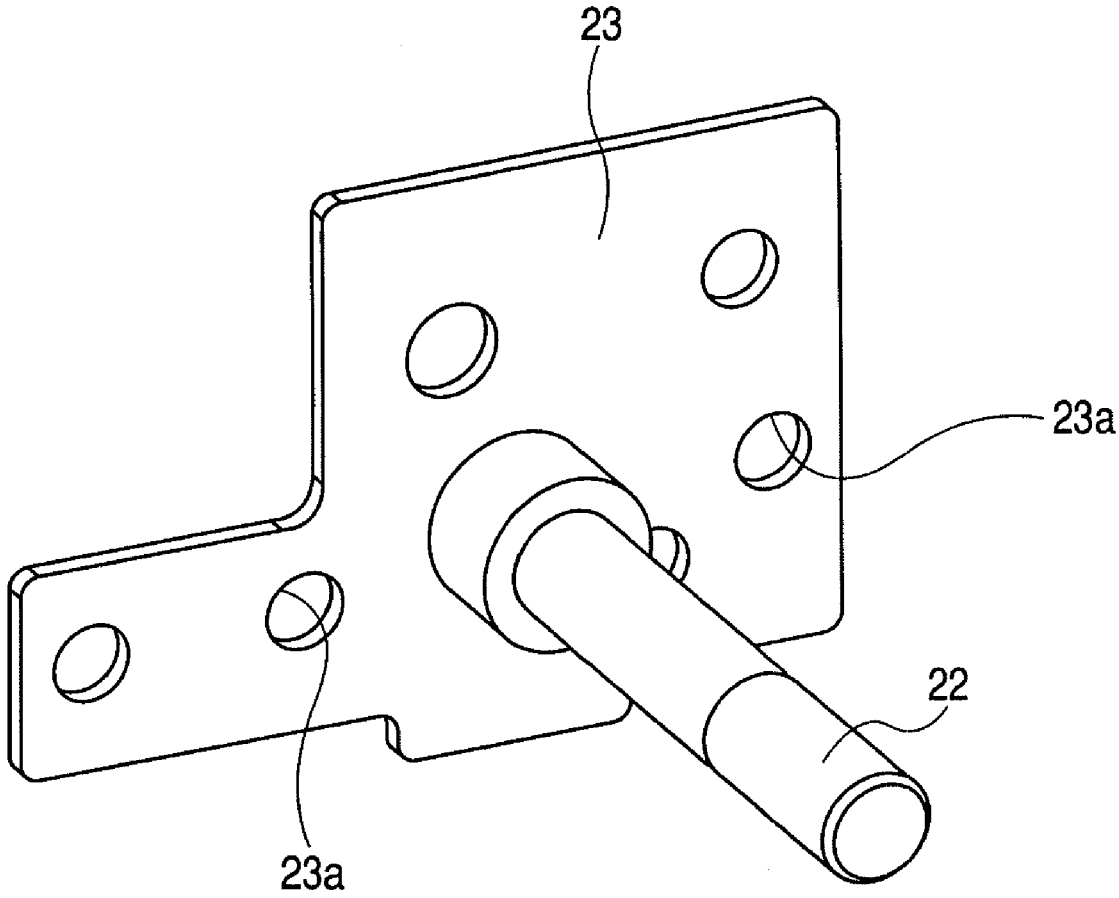
FIG. 9 is an enlarged perspective view in the vicinity of a second gear pivot.

FIGS. 1 to 2 show a thermal transfer line printer according to an embodiment of the disclosure. Specifically, FIG. 1 is an external perspective view showing essential parts, FIG. 2 is a partially exploded and enlarged perspective view of the essential parts, FIG. 3 is a front view in the vicinity of a re-transmission mechanism, FIG. 4 is an enlarged perspective view in the vicinity of a first gear pivot, FIG. 5 is an enlarged front view of a lower plate, FIG. 6 is an enlarged front view of an upper plate, FIG. 7 is an enlarged front view showing a state where the upper plate is superposed on the lower plate, FIG. 8 is an enlarged front view showing an example of a state where the position of the upper plate superposed on the lower plate has been moved, and FIG. 9 is an enlarged perspective view in the vicinity of a second gear pivot.

As the thermal transfer line printer of the present embodiment, a small printer that can record a full color image on a recording medium and that is about 150 mm in a longitudinal dimension, about 180 mm in a transverse direction, and about 80 mm in a height dimension as a whole is exemplified.

As shown in FIG. 1, the thermal transfer line printer 1 of the present embodiment has a printer frame 2. As shown in FIG. 2, the printer frame 2 is formed in the shape of the letter "U" having a top opening as a whole such that lower ends of side plates 2*b* and 2*c* extending parallel to each other so as to face each other are respectively connected to both ends that are located in the oblique lower right and upper left positions (FIG. 2) of a bottom plate 2*a* that is formed substantially in the shape of a flat plate.

As shown in FIG. 2, a platen roller 3, and one pair of conveying rollers 4 and 5 composed of a first conveying roller 4 that is disposed on the right side of the platen roller 3 with the platen roller 3 therebetween, and a second conveying roller 5 that is disposed on the left side of the platen roller 3 are disposed in the printer frame 2. The platen roller 3 and the one pair of conveying rollers 4 and 5 are rotatably disposed in the printer frame 2 such that their axes extend parallel to each other.

In the present embodiment, both ends of each of the platen roller 3 and the one pair of conveying rollers 4 and 5 project outward from both side plates 2*b* and 2*c* of the printer frame 2. These ends are inserted into and are rotatably supported by inner holes of three cylindrical bearings 6*a*, 6*b*, and 6*c* that are provided in predetermined positions of roller support frames 6 (only one support frame is shown in FIG. 2) formed from resin, etc. and mounted on the outsides (outside surfaces opposite mutually opposed inner surfaces of both side plates 2*b* and 2*c*) of both side plates 2*b* and 2*c* of the printer frame 2 by means of screws, etc.

Figure 11:
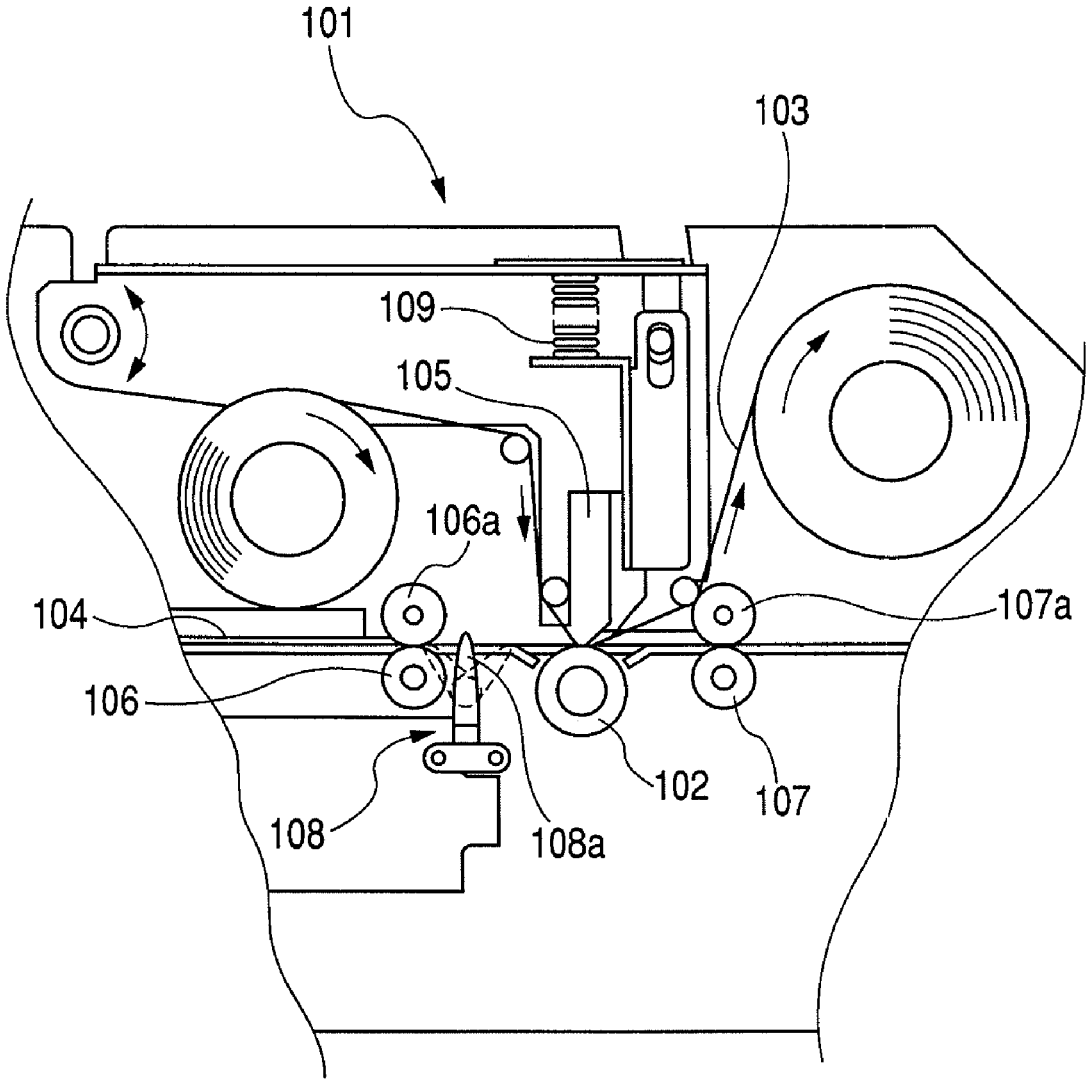
FIG. 11 is a front view showing essential parts of an example of a conventional thermal transfer line printer.

Further, a line thermal head (refer to reference numeral 105 of FIG. 11) that is not shown is disposed above the platen roller 3. Similarly to the related art, this line thermal head has such a length that it can face a longitudinal or transverse range of a recording medium (refer to reference numeral 104 of FIG. 11), and is provided so as to face the platen roller 3, and so as to be able to be brought close to or separated from the platen roller 3. Accordingly, the platen roller 3 is formed with a length corresponding to the lengths of a recording medium and a line thermal head.

A driving force transmission gear 7 is detachably mounted on one end of the platen roller 3, specifically a portion projecting from the roller support frame 6 in the present embodiment. Further, a first driven gear 8 serving as a driven roller is detachably mounted on one end of the first conveying roller 4, specifically a portion projecting from the roller support frame 6 in the present embodiment. Moreover, a second driven gear 9 serving as a driven roller is detachably mounted on one end of the second conveying roller 5, specifically a portion projecting from the roller support frame 6 in the present embodiment.

As shown in FIG. 3, an input gear 10, composed of a worm wheel, always meshes with the driving force transmission gear 7. The driving force transmission gear 7, and an output gear 12, composed of a worm that is mounted on an output axis 11*a* of a driving motor 11 that is a driving member for rotationally driving the platen roller 3, is connected to the input gear 10. In addition, the input gear 10 is formed by a two-stage gear having a large-diameter gear element that always meshes with the output gear 12, and a small-diameter gear element that is formed coaxially with the large-diameter gear element, and rotates integrally with the small-diameter gear element. The driving motor 11 may be for example a stepping motor that can rotate in forward and reverse directions.

As shown in FIGS. 2 and 3, a first intermediate gear 13, which serves as an intermediate gear that always meshes with both the driving force transmission gear 7 and the first driven gear 8, is disposed between the driving force transmission gear 7 and the first driven gear 8. Further, a second intermediate gear 14, which serves as an intermediate gear that always meshes with both the driving force transmission gear 7 and the second driven gear 9, is disposed between the driving force transmission gear 7 and the second driven gear 9.

The driving force transmission gear 7 mounted on the platen roller 3, the driven rollers 8 and 9 mounted on a pair of the conveying rollers 4 and 5, respectively, and the intermediate gears 13 and 14 that always mesh with the driving force transmission gear 7, and both the driven rollers constitute a re-transmission mechanism 15 that re-transmits the driving force transmitted to the platen roller 3 from the driving motor 11 of the present embodiment to each of the one pair of conveying rollers 4 and 5. This re-transmission mechanism 15 is formed so that each of the one pair of conveying rollers 4 and 5 may rotate in the same direction as the direction of rotation of the platen roller 3.

The first intermediate gear 13 is inserted into an axial intermediate portion of a first gear supporting shaft 16 serving as a gear supporting shaft, and is rotatably supported thereby. The first gear supporting shaft 16, as shown in FIG. 4 has a base end fixed to a first shaft mounting frame 17 by fitting, etc. That is, the first gear supporting shaft 16 is disposed in the first shaft mounting frame 17 so that it may be erected along a thickness direction of the first shaft mounting frame 17. Further, the first shaft mounting frame 17 is provided with a through-hole 17*a* through which one end of the platen roller 3 is inserted.

As shown in FIGS. 2 and 4, three first shaft mounting holes 17*b* are formed in the first shaft mounting frame 17 so as to pass through the frame in its thickness direction. By screwing distal ends of mounting screws (not shown) inserted through the first mounting holes 17*b* from the side where the distal end of the first gear supporting shaft 16 is arranged into screw holes (not shown) that are formed in predetermined positions of the side plate 2*b* of the printer frame 2, the first shaft mounting frame 17, and the first gear supporting shaft 16 are mounted to the side plate 2*b* of the printer frame 2. Further, the first mounting holes 17*b* are formed so as to have a larger inner diameter than the outer diameter of externally threaded portions of the mounting screws, and are formed so that the position of the first mounting holes 17*b* with respect to the centers (axes) of the mounting screws can be shifted within the range of a gap between the first mounting holes 17*b* and the externally threaded portions of the mounting screws. Also, by shifting the position of the first mounting holes 17*b* with respect to the centers of the mounting screws, the position of the first shaft mounting frame 17, and the position of the first gear supporting shaft 16 that becomes the center of rotation of the first intermediate gear 13 can be adjusted.

That is, the first gear supporting shaft 16 is configured so that both the center distance between the axis of the first intermediate gear 13 and the axis of the driving force transmission gear 7 and the center distance between the axis of the first intermediate gear 13 and the axis of the first driven gear 8 can be adjusted.

As shown in FIGS. 1 and 2, the distal end of the first gear supporting shaft 16 opposite its base end projects from a first through-hole 18*a* formed in a first sub-frame 18 detachably mounted to the printer frame 2 by means of screws, etc. (not shown). Through this distal end, a lower fixing hole 19*a* of a lower plate 19 and an upper fixing hole 20*a* of an upper plate 20 are inserted in this order.

As shown in FIG. 5, the lower plate 19 is formed in a vertically long rectangular shape that is long in the vertical direction of FIG. 5 as a whole, and a guide hole 19*b* in the shape of a long hole is formed almost in an intermediate portion of the lower plate in the horizontal direction of FIG. 5.

A lower mounting hole 19*c* through which a mounting screw (bolt) 21 (FIG. 2) is inserted is formed in the vicinity of a lower left corner portion of the lower plate 19 so that its longitudinal direction may be a vertical direction. That is, the lower mounting hole 19*c* is arranged so as to extend parallel to the guide hole 19*b* in a lower portion of the guide hole 19*b*. The longitudinal dimension of the lower mounting hole 19*c* is made smaller than the longitudinal dimension of the guide hole 19*b*. Further, the size of the lower mounting hole 19*c* in the width direction orthogonal to its longitudinal direction is made larger than the diameter of an externally threaded portion of the mounting screw 21 so that the externally threaded portion of the mounting screw 21 can be inserted through the lower mounting hole.

A lower fixing hole 19*a*, in the shape of a long hole through which the first gear supporting shaft 16 is inserted, is formed in the vicinity of a lower right corner portion of the lower plate 19. The longitudinal dimension of the lower fixing hole 19*a* is made smaller than the longitudinal dimension of the guide hole 19*b*, similarly to the lower mounting hole 19*a*. Further, the lower fixing hole 19*a* is arranged so as to incline towards the lower left from the upper right of FIG. 4 so that its longitudinal direction may make an angle of about 45 degrees with respect to the longitudinal direction of the guide hole 19*b*. Moreover, the size of the lower fixing hole 19*a* in a width direction orthogonal to its longitudinal direction is made larger than the diameter of the first gear supporting shaft 16 so that the first gear supporting shaft 16 can be inserted through the lower fixing hole.

As shown in FIG. 6, the upper plate 20 is formed in a vertically long rectangular shape that is long in the vertical direction of FIG. 6 as a whole. Circular convex portions 20*b*, which are to be fitted into the guide hole 19*b* of the lower plate 19, are formed on the rear faces of two spots including a substantially central portion and its upper portion of FIG. 6 by recessing one surface in a circular shape by press working, etc. The mutual distance between the two convex portions 20*b* is set to about the half of the length of the guide hole 19*b* of the lower plate 19, and when the upper plate 20 is superposed on the lower plate 19, both the convex portions 20*b* can be fitted into guide hole 19*b*, and both the convex portions 20*b* can be moved along with the longitudinal direction of the guide hole 19*b*. That is, in a state where both the convex portions 20*b* are fitted into the guide hole 19*b* and the upper plate 20 is superposed on the lower plate 19, along the longitudinal direction of the guide hole 19*b*, the upper plate 20 can be moved with respect to the lower plate 19, or the lower plate can be moved to the upper plate 20.

Similarly to the lower plate 19, an upper mounting hole 20*c* in the shape of a long hole through which the mounting screws 21 are inserted is formed in the vicinity of a lower left corner portion of the upper plate 20 so that its longitudinal direction may be a vertical direction. When the upper plate 20 is superposed on the lower plate 19, the mounting screws 21 can be inserted through both the lower mounting hole 19*c* and the upper mounting hole 20*c* even when both the convex portions 20*b* are fitted into the guide hole 19*b*, and are moved along the longitudinal direction of the guide hole 19*b*. Further, the upper mounting hole 20*c* is arranged so that its longitudinal direction may extend parallel to the arranging direction of both the convex portions 20*b*. Further, the upper mounting hole 20*c* is formed in the same shape and the same dimension as the lower mounting hole 19*c*.

Similarly, a lower fixing hole 19*a*, which is in the shape of a long hole through which the first gear supporting shaft 16 is inserted, is formed in the vicinity of a lower right corner portion of the upper plate 20. The upper fixing hole 20*a* is arranged so as to incline towards the lower left from the upper right of FIG. 5 so that its longitudinal direction may make an angle of about 45 degrees with respect to the arranging direction of both the convex portions 20*b*. That is, the longitudinal direction of the upper fixing hole 20*a* is arranged along a direction orthogonal to the longitudinal direction of the lower fixing hole 19*a* when the upper plate 20 is superposed on the lower plate 19. Moreover, the size of the lower fixing hole 20*a* in a width direction orthogonal to its longitudinal direction is made larger than the diameter of the first gear supporting shaft 16 (equal to the lower fixing hole 19*a*) so that the first gear supporting shaft 16 can be inserted through the lower fixing hole. Further, the longitudinal dimension of the upper fixing hole 20*a* is made equal to the longitudinal dimension of the lower fixing hole 19*a*.

As shown in FIG. 7, as for the lower plate 19 and the upper plate 20, a substantially quadrangular window that can support the distal end of the first gear supporting shaft 16 at four points from the axial outside is formed by overlapping the lower fixing hole 19*a* and the upper fixing hole 20*a* in a state where both the convex portions 20*b* are fitted into the guide hole 19*b* and the upper plate 20 is superposed on the lower plate 19. Further, as for the lower plate 19 and the upper plate 20, the position where the window is formed can be moved by moving both the convex portions 20*b* along the guide hole 19*b*. For example, when both the convex portions 20*b* shown in FIG. 8 are moved upward of FIG. 7 along the guide hole 19*b*, the position where the window is formed will be moved to the right as shown in FIG. 8.

That is, even if the position of the distal end of the first gear supporting shaft 16 is changed, both the convex portions 20*b* are moved along the guide hole 19*b*, so that the distal end of the first gear supporting shaft 16 can be firmly supported and fixed at four points without applying a force that might bend the first gear supporting shaft 16.

In addition, the vertical displacement of the position where the window is formed can be performed by movement of the vertical mounting position (shown in FIG. 7) of the mounting hole 19*c* and the upper mounting hole 20*c* with respect to the mounting screws 21.

As such, the formation position of the quadrangular window that is formed by overlapping the lower fixing hole 19*a* and the upper fixing hole 20*a* that are formed so as to be orthogonal to each other in the longitudinal direction can be changed by moving both the convex portions 20*b* along the guide hole 19*b*. Thus, even if there is any variation in the working precision of parts that fix the distal end of the first gear supporting shaft 16, the distal end of the first gear supporting shaft 16 can be fixed firmly, without giving a force that might bend the first gear supporting shaft 16. That is, it is not necessary to enhance the working precision of the parts that fix the distal end of the first gear supporting shaft 16.

The lower plate 19 and the upper plate 20 are mounted on the first sub frame 18 by screwing the distal ends of the mounting screws 21 that are sequentially inserted through the upper mounting hole 20*c* and the lower mounting hole 19*c* that are formed in the shape of a long hole into screw holes (not shown) formed in the first sub frame 18.

Accordingly, after the position of the first gear supporting shaft 16 is adjusted, the position of the distal end of the first gear supporting shaft 16 can be fixed by the lower fixing hole 19*a* of the lower plate 19, and the upper fixing hole 20*a* of the upper plate 20. Consequently, the position of both ends of the gear supporting shaft after the positional adjustment is fixed. In addition, the lower plate 19 and the upper plate 20 may be arranged so as to be turned upside down. Moreover, a configuration in which several convex portions 20*b* are provided on the lower plate 19, and a guide hole 19*b* is provided in the upper plate 20 may be adopted.

The second intermediate gear 14 is inserted into an axial intermediate portion of a second gear supporting shaft 22 serving as a gear supporting shaft, and is rotatably supported thereby. The second gear supporting shaft 22, as shown in FIG. 8 has a base end fixed to a second shaft mounting frame 23 by fitting, etc. That is, the second gear supporting shaft 22 is disposed in the second shaft mounting frame 23 so that it may be erected along a thickness direction of the second shaft mounting frame 23.

Two second mounting holes 23*a* are formed in the second shaft mounting frame 23 so as to pass therethrough in its thickness direction. By screwing distal ends of mounting screws (not shown) inserted through the second mounting holes 23*a* from the side where the distal end of the second gear supporting shaft 22 is arranged into screw holes (not shown) that are formed in predetermined positions of the side plate 2*b* of the printer frame 2, the second shaft mounting frame 23, and the second gear supporting shaft 22 are mounted to the side plate 2*b* of the printer frame 2. Further, the second mounting holes 17*b* are formed so as to have a larger inner diameter than the outer diameter of externally threaded portions of the mounting screws, and are formed so that the position of the second mounting holes 23*a* with respect to the centers (axes) of the mounting screws can be shifted within the range of a gap between the second mounting holes 23*a* and the externally threaded portions of the mounting screws. Also, by shifting the position of the second mounting holes 23*a* with respect to the centers of the mounting screws, the mounting position of the second shaft mounting frame 23, and the position of the second gear supporting shaft 22 that becomes the center of rotation of the second intermediate gear 14 can be adjusted.

That is, the second gear supporting shaft 22 is configured so that both the center distance between the axis of the second intermediate gear 14 and the axis of the driving force transmission gear 7 and the center distance between the axis of the second intermediate gear 14 and the axis of the second driven gear 9 can be adjusted.

As shown in FIGS. 1 and 2, the distal end of the second gear supporting shaft 16 opposite its base end, similarly to the distal end of the first gear supporting shaft 15 as mentioned above, projects from a second through-hole 24*a* formed in a second sub-frame 24 detachably mounted to the printer frame 2 by means of screws, etc. (not shown). Through this distal end of the second gear supporting shaft 22, a lower fixing hole 19*a* of a lower plate 19 and an upper fixing hole 20*a* of an upper plate 20 are inserted in this order, similarly to the first gear supporting shaft 16 as mentioned above. Accordingly, even if the position of the distal end of the second gear supporting shaft 22 is changed, both the convex portions 20*b* are moved along the guide hole 19*b*, so that the distal end of the second gear supporting shaft 22 can be firmly supported and fixed at four points without applying a force that might bend the second gear supporting shaft 22.

Since the configuration and operation of the lower plate 19 and the upper plate 20 that fix the distal end of the second gear supporting shaft 22 are the same as those of the lower plate 19 and the upper plate 20 that fix the distal end of the first gear supporting shaft 16 as mentioned above, detailed description thereof is omitted herein.

The lower plate 19 and the upper plate 20 through which the distal end of the second gear supporting shaft 22 is inserted are mounted on the second sub frame 24 by screwing the distal ends of the mounting screws 21 that are sequentially inserted through the upper mounting hole 20*c* and the lower mounting hole 19*c* into screw holes (not shown) formed in the second sub frame 24.

Accordingly, after the position of the second gear supporting shaft 22 is adjusted, the position of the distal end of the second gear supporting shaft 22 can be fixed by the lower fixing hole 19*a* of the lower plate 19, and the upper fixing hole 20*a* of the upper plate 20. Consequently, the position of both ends of the gear supporting shaft after the positional adjustment is fixed.

Figure 10:
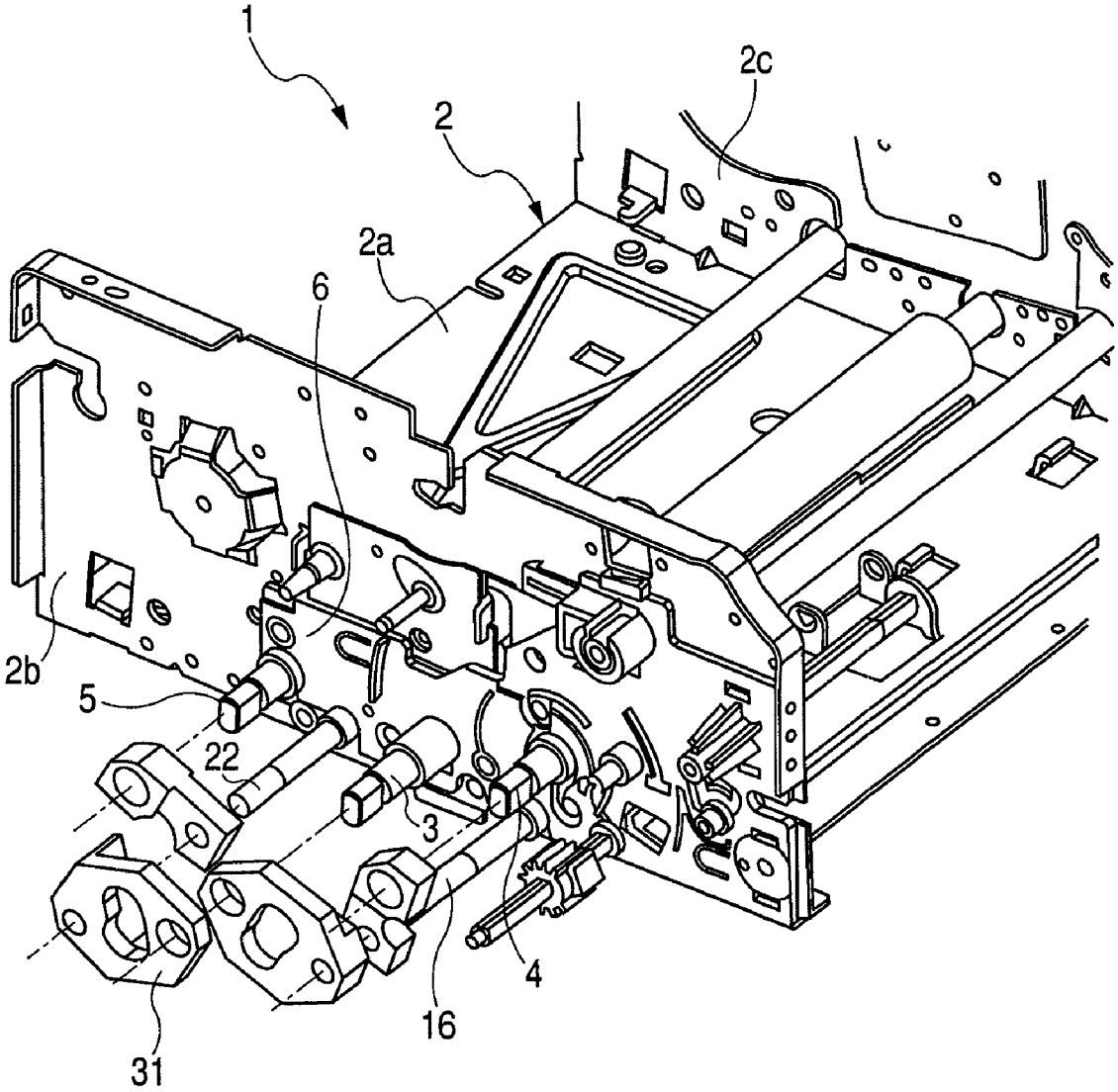
FIG. 10 is an explanatory view illustrating an adjustment state of center distance.

In addition, in the thermal transfer line printer 1 of the present embodiment, the adjustment of the position of the first and second gear supporting shafts 16 and 22, that is, the adjustment of each of the center distance between the axis of the first intermediate gear 13, and the axis of the driving force transmission gear 7, the center distance between the axis of the second intermediate gear 14, and the axis of the driving force transmission gear 7, the center distance between the axis of the first inside open gear 13, and the axis of the first driven gear 8, and the center distance between the axis of the second intermediate gear 14, and the axis of the second driven gear 9 is carried out by using a plurality of blocks 31 each including a pair of mounting holes that allows mounting to a shaft as shown in FIG. 10.

Further, each center distance is kept by mounting the first and second frames 17 and 23 to the side plate 2*b* of the printer frame 2 in a state where each center distance is adjusted.

In addition, each gear, etc. is mounted on a predetermined position after each center distance is adjusted. Then, the first and second sub frames 18 and 24 are mounted on the side plate 2*b* of the printer frame 2. Thereafter, the lower plate 19 and the upper plate 20 are mounted on the first and second sub frame 18, 24, respectively. Thereby, assembling can be made in a state where the position of both ends of each of the first and the second gear supporting shafts 16 and 22 is fixed.

Further, when each center distance is changed, such a change can be made easily by using blocks that are different in the mutual distance between one pair of mounting holes. For example, plural types of blocks 31 whose mutual distances between a pair of mounting holes are set to distances that are different every 0.025 mm with respect to a theoretical value in design are formed in advance, and a block 31 to be used may be changed depending on every rod of the driving motor 11.

Since other configurations are the same as those of the conventional thermal transfer line printer, detailed description thereof is omitted herein.

Next, the operation of the present embodiment configured as mentioned above will be described. In addition, since recording operation onto a recording medium according to the thermal transfer line printer 1 of the present embodiment is the same as that of the conventional thermal transfer line printer, detailed description thereof is omitted herein.

According to the thermal transfer line printer 1 of the present embodiment, a driving force transmitted to the platen roller 3 is re-transmitted to one pair of conveying rollers 4 and 5 by the re-transmission mechanism 15, so that each of the one pair of conveying rollers 4 and 5 can be driven to follow the platen roller 3. Thus, the platen roller 3 and the one pair of conveying rollers 4 and 5 can be driven by one driving motor 11. Also, the total number of gears between a driving member and a driven member can be reduced, and the amount of the backlash of a driving force transmission path can be reduced.

Moreover, according to the thermal transfer line printer 1 of the present embodiment, the numbers of gears in the driving force transmission paths from the platen roller 3 to the one pair of conveying rollers 4 and 5, respectively, can be made equal to each other. Therefore, the amounts of backlash in the driving force transmission paths can be made equal to each other.

Furthermore, according to the thermal transfer line printer 1 of the present embodiment, the position of each of the gear supporting shafts 16 and 22 can be adjusted. Thus, it is possible to easily and reliably control the amount of the backlash between the intermediate gear 13 or 14 and the driving force transmission gear 7, and the amount of the backlash between the intermediate gear 13 or 14 and the driven roller 8 or 9. As a result, the delay of starting timing of each of the one pair of conveying rollers 4 and 5 to the starting timing of the platen roller 3 including the time of switching of the platen roller 3 in the direction of rotation can be controlled according to the amount of backlash, and thereby, both the direction and amount of color deviation can be controlled.

Accordingly, according to the thermal transfer line printer 1 of the present embodiment, conveyance unevenness of a recording medium hardly occurs. Thus, high-quality recording with no color deviation can be performed easily and reliably.

Further, according to the thermal transfer line printer 1 of the present embodiment, the position of both ends of each of the gear supporting shafts 16 and 22 is fixed. Thus, it is possible to surely prevent the gear supporting shafts 16 and 22 from being displaced together with the intermediate gears 13 and 14 due to a load applied to the intermediate gears 13 and 14, etc. As a result, it is possible to prevent increases in the wear, vibration, rotational load, etc. in gear driving generated when the gear supporting shafts 16 and 22 have been displaced, and it is possible to surely prevent each center distance from changing at the time of recording operation.

In addition, when only one end of each of the gear supporting shafts 16 and 22 is fixed, a distal end becomes a free end. Thus, due to a load applied to the intermediate gears 13 and 14, the gear supporting shafts 16 and 22 are easily displaced along with the intermediate gears 13 and 14. This displacement is easily generated as the diameter of each of the gear supporting shafts 16 and 22 become smaller, that is, as an attempt to reduce the thermal transfer line printer 1 is made.

Further, according to the thermal transfer line printer 1 of the present embodiment, the distal end of each of the gear supporting shafts 16 and 22 is formed so that it can be fixed without applying a force that will bend the gear supporting shafts 16 and 22. Thus, the distal end of each of the gear supporting shafts 16 and 22 can be fixed firmly. As a result, since there is no deflection in the gear supporting shafts 16 and 22, generation of any positional deviation of the intermediate gears 13 and 14 caused by bending of the gear supporting shafts 16 and 22 can be prevented. That is, it is possible to easily and surely arrange the intermediate gears 13 and 14 in optimal positions.

In addition, the invention is not limited to the aforementioned embodiment, and various changes thereof can be made, if necessary.

The invention claimed is:

1. A thermal transfer line printer comprising:

a platen roller to which the driving force of a driving motor is transmitted, and that is rotationally driven in the forward rotation direction or reverse rotation direction;

a line thermal head that is provided so as to face the platen roller and so as to be brought close to or separated from the platen roller;

one pair of conveying rollers that are rotatably disposed with the platen roller therebetween; and a re-transmission mechanism that re-transmits the driving force, which is transmitted to the platen roller from the driving motor, to each of the one pair of conveying rollers, wherein the re-transmission mechanism includes a driving force transmission gear mounted on the platen roller, a driven roller mounted on each of the one pair of conveying rollers, and an intermediate gear that always meshes with both the driving force transmission gear and the driven roller, and each of the one pair of conveying rollers is formed so as to be rotationally driven in the same direction as the direction of rotation of the platen roller, and wherein the intermediate gear is rotatably supported by a gear supporting shaft, and the gear supporting shaft is adjusted in position so that both the center distance between the axis of the intermediate gear and the axis of the driving force transmission gear and the center distance between the axis of the intermediate gear and the axis of the driven roller can be adjusted.

2. The thermal transfer line printer according to claim 1, wherein the position of both ends of the gear supporting shaft after positional adjustment is fixed.

3. The thermal transfer line printer according to claim 2, wherein a distal end of the gear supporting shaft is formed so as to be able to be fixed without applying the force that will bend the gear supporting shaft.

* * * * *